US008407053B2

(12) United States Patent
Latorre et al.

(10) Patent No.: US 8,407,053 B2
(45) Date of Patent: Mar. 26, 2013

(54) SPEECH PROCESSING APPARATUS, METHOD, AND COMPUTER PROGRAM PRODUCT FOR SYNTHESIZING SPEECH

(75) Inventors: Javier Latorre, Tokyo (JP); Masami Akamine, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1044 days.

(21) Appl. No.: 12/405,587

(22) Filed: Mar. 17, 2009

(65) Prior Publication Data

US 2009/0248417 A1 Oct. 1, 2009

(30) Foreign Application Priority Data

Apr. 1, 2008 (JP) ..... 2008-095101

(51) Int. Cl.
*G10L 13/08* (2006.01)

(52) U.S. Cl. ..... 704/260

(58) Field of Classification Search ..... 704/260
See application file for complete search history.

(56) References Cited

U.S. PATENT DOCUMENTS

| | | | | |
|---|---|---|---|---|
| 4,908,867 | A * | 3/1990 | Silverman | 704/260 |
| 5,220,639 | A * | 6/1993 | Lee | 704/200 |
| 5,602,960 | A * | 2/1997 | Hon et al. | 704/207 |
| 5,740,320 | A * | 4/1998 | Itoh | 704/267 |
| 5,751,905 | A * | 5/1998 | Chen et al. | 704/254 |
| 6,101,470 | A * | 8/2000 | Eide et al. | 704/260 |
| 6,510,410 | B1 * | 1/2003 | Chen et al. | 704/251 |
| 6,553,342 | B1 * | 4/2003 | Zhang et al. | 704/255 |
| 6,910,007 | B2 * | 6/2005 | Stylianou et al. | 704/207 |
| 7,043,430 | B1 * | 5/2006 | Chung et al. | 704/251 |
| 7,181,391 | B1 * | 2/2007 | Jia et al. | 704/231 |
| 2002/0152246 | A1 * | 10/2002 | Critchlow | 707/535 |
| 2003/0004723 | A1 * | 1/2003 | Chihara | 704/260 |
| 2003/0202641 | A1 * | 10/2003 | Huang | 379/88.13 |
| 2004/0030555 | A1 * | 2/2004 | van Santen | 704/260 |
| 2005/0175167 | A1 * | 8/2005 | Yacoub et al. | 379/265.13 |
| 2006/0229877 | A1 * | 10/2006 | Tian et al. | 704/267 |
| 2009/0119102 | A1 * | 5/2009 | Bangalore et al. | 704/240 |

OTHER PUBLICATIONS

Keiichi Tokuda, et al., "Speech Parameter Generation From HMM Using Dynamic Features", Proceedings ICASSP, 1995, pp. 660-663.
Keiichi Tokuda, et al., "Hidden Markov Models Based on Multi-Space Probability Distribution for Pitch Pattern Modeling", Proceedings ICASSP, 1999, 4 pages.
Tomoki Toda, et al., "Speech Parameter Generation Algorithm Considering Global Variance for HMM-Based Speech Synthesis", Proceedings Interspeech, 2005, pp. 2801-2804.

* cited by examiner

*Primary Examiner* — Talivaldis Ivars Smits
(74) *Attorney, Agent, or Firm* — Oblon, Spivak, McClelland, Maier & Neustadt, L.L.P.

(57) ABSTRACT

A speech processing apparatus, including a segmenting unit to divide a fundamental frequency signal of a speech signal corresponding to an input text into pitch segments, based on an alignment between samples of at least one given linguistic level included in the input text and the speech signal. Character strings of the input text are divided into the samples based on each linguistic level. A parameterizing unit generates a parametric representation of the pitch segments using a predetermined invertible operator and generates a group of first parameters in correspondence with each linguistic level. A descriptor generating unit generates, for each linguistic level, a descriptor that includes a set of features describing each sample in the input text and a model learning unit classifies the first parameters of each linguistic level of all speech signals in a memory into clusters based on the descriptor corresponding to the linguistic level.

14 Claims, 5 Drawing Sheets

SPEECH PROCESSING APPARATUS, METHOD, AND COMPUTER PROGRAM PRODUCT FOR SYNTHESIZING SPEECH

CROSS-REFERENCE TO RELATED APPLICATIONS

This application is based upon and claims the benefit of priority from the Japanese Patent Application No. 2008-095101, filed on Apr. 1, 2008; the entire contents of which are incorporated herein by reference.

BACKGROUND OF THE INVENTION

1. Field of the Invention

The present invention relates to a speech processing apparatus, method, and computer program product for synthesizing speech.

2. Description of the Related Art

A speech synthesizing device, which synthesizes speech from a text, includes three main processing units: a text analyzing unit, a prosody generating unit, and a speech signal generating unit. The text analyzing unit analyzes an input text (containing latin characters, kanji (Chinese characters), kana (Japanese characters or any other type of characters)) by using a dictionary or the like, and outputs linguistic information defining how to pronounce the text, where to put a stress, how to segment the sentence (into accentual phrases), and the like. Based on the linguistic information, the prosody generating unit outputs phonetic and prosodic information, such as a voice pitch (fundamental frequency) pattern (hereinafter, "pitch contour") and the length of each phoneme. The speech signal generating unit selects speech units in accordance with the arrangement of phonemes, connects the units together while modifying them in accordance with the prosodic information, and thereby outputs synthesized speech. It is well known that, among those three processing units, the prosody generating units that generates the pitch contour has a significant influence on the quality and naturalness of the synthesized speech.

Various techniques for generating a pitch contour have been suggested, such as classification and regression trees (CART), linear models, and hidden Markov model (HMM). These techniques can be classified into two types:

(1) Outputting a definitive value for each segment of the utterance (usually for each unit of the utterance at a given linguistic-level): Techniques based on a code book and on a linear model belong to this type.

(2) Outputting multiple possible values for each segment of the utterance (usually for each unit of the utterance at a given linguistic-level): In general, an output vector is modeled in accordance with a probability distribution function, and a pitch contour is formed in such a manner that a solution of an objective function consisting of multiple subcosts, such as likelihoods, is maximized. An example of this type is HMM-based technique proposed in "Speech parameter generation from HMM using dynamic features" by Tokuda, K., Masuko, T., Imai, S., 1995, Proc. ICASSP, Detroit, USA, pp. 660-663; and "Hidden Markov models based on multi-space probability distribution for pitch pattern modeling" by Tokuda, K., Masuko, T., Miyazaki, N., and Kobayashi, T., 1999, Proc. ICASSP, Phoenix, Ariz., USA, pp. 229-232.

For techniques belonging to the method (1), where a definitive value is generated for the considered linguistic-level units, it is difficult to produce a smoothly changing pitch contour. The reason is that the pitch patterns generated for each unit may not match with the pitch patterns generated for the adjacent units at the connecting point to each other. This creates an abnormal sound or a sudden change in intonation, that prevents the speech from sounding natural. Hence, this methods challenge is how to connect individually generated pitch segments to one another so that the final speech does not sound discontinuous or abnormal.

The above problem is often tried to be solved by means of a filtering process onto the sequence of generated pitch segments that smooth the gaps. However, even if the gaps between pitch segments at the connection points are reduced to some extent, it is still difficult to make the pitch contour evolve in a continuous way so that smooth speech is obtained. In addition, if the filtering is too intensely applied, the pitch contour becomes blunt, which, again, makes the speech sound unnatural. Furthermore, parameters of the filtering process need to be adjusted by trial-and-error methods while checking the sound quality. This requires considerable time and labor.

The above problem regarding the pitch connection may be mended by the method of outputting multiple possible values represented by a statistical distribution as shown in (2). However, this method tends to excessively smooth the generated pitch contour and thus make it blunt, resulting in an unnatural sounding speech. The blunt pitch pattern may be fixed by artificially widen the variance of the generated pitches as proposed in "Speech parameter generation algorithm considering global variance for HMM-Based speech synthesis" by Toda, T. and Tokuda, K., 2005, Proc. Interspeech 2005, Lisbon, Portugal, pp. 2801-2804. However, the problem still remains, because the widening of small local differences in the pitch contour can make the global pitch contour unstable. An additional problem of standard HMM-based method is that in order to model together the spectral and the pitch information, the basic linguistic units are defined at a segmental level, i.e. frame by frame. However, pitch is basically a supra-segmental signal. In standard HMM-based method, supra-segmental information is introduced through the model clustering and selection. However, this lack of an explicit modeling at supra-segmental level makes difficult to control certain speech characteristics such as emphasis, excitation, etc. Moreover, in such framework it is not clear how to create and integrate models for other linguistic levels such as syllable or breath group that present different dimension for each unit and consequently, a different range of effect over surrounding pitch segments.

SUMMARY OF THE INVENTION

According to one aspect of the present invention, a speech processing apparatus includes a segmenting unit configured to divide a fundamental frequency of a speech signal corresponding to an input text into a plurality of pitch segments, based on an alignment between character strings of each linguistic level included in the input text and the speech signal; a parameterizing unit configured to generate a parametric representation of the pitch segments by means of a predetermined invertible operator such as a linear transform, and generates a group of first parameters in correspondence with the linguistic level; a descriptor generating unit configured to generate a descriptor which consists of a set of features describing the character strings, for each of the character strings in the linguistic level included in the input text; a model learning unit configured to classify the first parameters of the linguistic level of all the speech signal in the database into clusters based on the descriptor corresponding to the linguistic level, and learns for each of the clusters a pitch segment model for the linguistic level; and a storage unit configured to store the pitch segment models for each linguistic level together with the mapping rules between the descriptors describing the features of the character strings for the linguistic level, and the pitch segment models.

According to another aspect of the present invention, a speech processing method includes dividing a fundamental frequency of a speech signal corresponding to an input text into a plurality of pitch segments, based on an alignment between character strings of each linguistic level included in the input text and the speech signal; generating a parametric representation of the pitch segments by means of a predetermined invertible operator such as a linear transform, and generating a group of first parameters in correspondence with the linguistic level; generating a descriptor which consists of a set of features describing the character strings, for each of the character strings in the linguistic level included in the input text; classifying the first parameters of the linguistic level of all the speech signal in the database into clusters based on the descriptor corresponding to the linguistic level, and learns for each of the clusters a pitch segment model for the linguistic level;

storing the pitch segment models for each linguistic level together with the mapping rules between the descriptors describing the features of the character strings for the linguistic level, and the pitch segment models in a storage unit.

A computer program product according to still another aspect of the present invention causes a computer to perform the method according to the present invention.

DETAILED DESCRIPTION OF THE INVENTION

Exemplary embodiments of a speech processing apparatus, method, and computer program product are explained in detail below with reference to the attached drawings.

Figure 1:
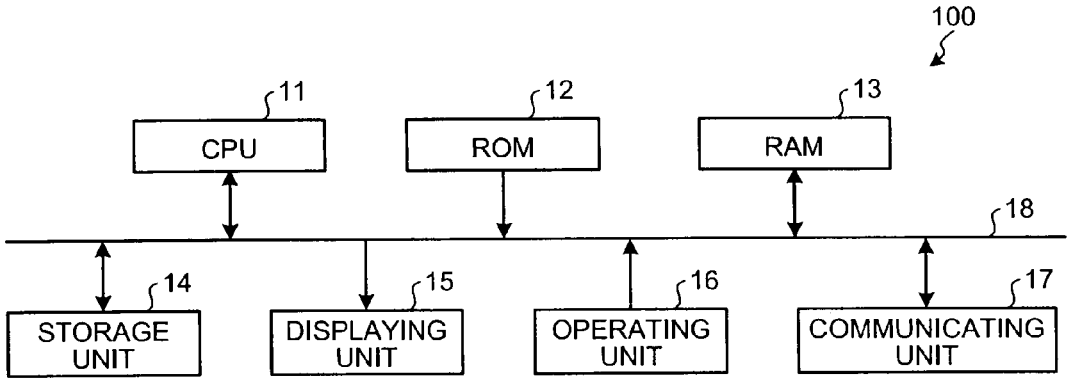
FIG. 1 is a block diagram of a hardware structure of a speech processing apparatus.

FIG. 1 is a block diagram of a hardware structure of a speech processing apparatus 100 according to an embodiment of the present invention. The speech processing apparatus 100 includes a central processing unit (CPU) 11, a read only memory (ROM) 12, a random access memory (RAM) 13, a storage unit 14, a displaying unit 15, an operating unit 16, and a communicating unit 17, with a bus 18 connecting these components to one another.

The CPU 11 executes various processes together with the programs stored in the ROM 12 or the storage unit 14 by using the RAM 13 as a work area, and has control over the operation of the speech processing apparatus 100. The CPU 11 also realizes various functional units, which are described later, together with the programs stored in the ROM 12 or the storage unit 14.

The ROM 12 stores therein programs and various types of setting information relating to the control of the speech processing apparatus 100 in a non-rewritable manner. The RAM 13 is a volatile memory such as a SDRAM and a DDR memory, providing the CPU 11 with a work area.

The storage unit 14 has a recording medium in which data can be magnetically or optically stored, and stores therein programs and various types of information relating to the control of the speech processing apparatus 100 in a rewritable manner. The storage unit 14 also stores statistical models of pitch segments (hereinafter, "pitch segment models") generated in units of different linguistic levels by a model learning unit 22, which will be described later. A linguistic level refers to a level of frames, phonemes, syllables, words, phrases, breath groups, the entire utterance, or any combination of these. According to the embodiment, different linguistic levels are dealt with for learning of the pitch segment models and generation of a pitch contour, which will be discussed later. In the following description, each linguistic level is expressed as "$L_i$" (where "i" is a positive integer), and different linguistic levels are identified by the numbers input for "i".

The displaying unit 15 is formed of a display device such as a liquid crystal display (LCD), and displays characters and images under the control of the CPU 11.

The operating unit 16 is formed of input devices such as a mouse and a keyboard, which receives information input by the user as an instruction signal and outputs the signal to the CPU 11.

The communicating unit 17 is an interface for realizing communications with external devices, and outputs various types of information received from the external devices to the CPU 11. The communicating unit 17 also sends various types of information to the external devices under the control of the CPU 11.

Figure 2:
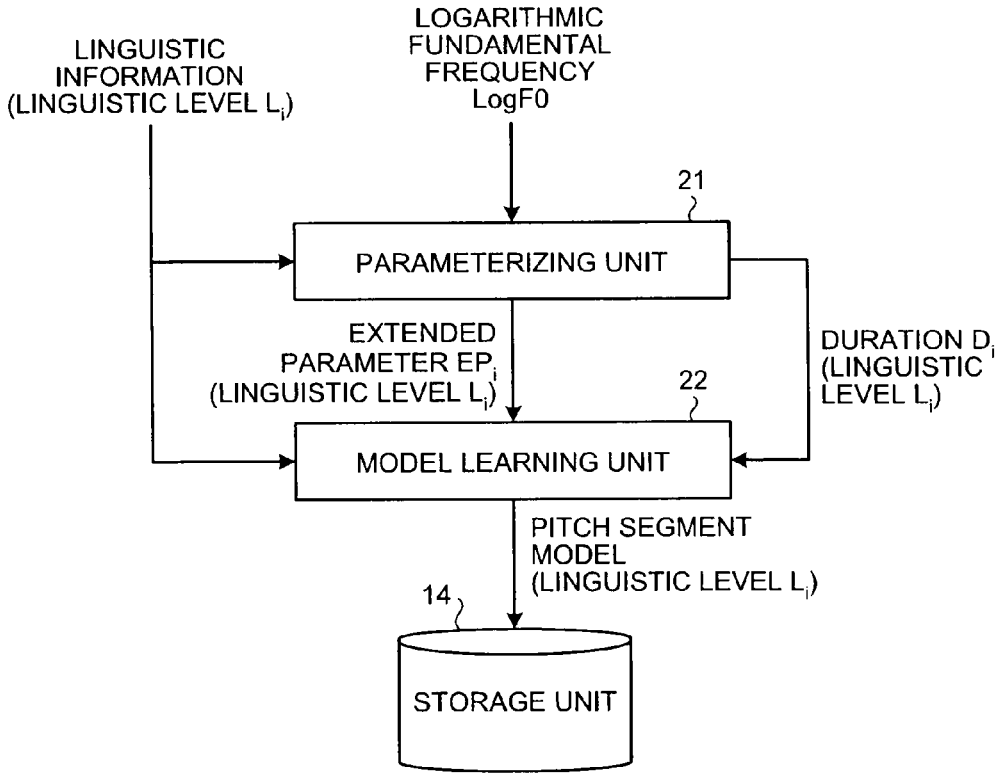
FIG. 2 is a block diagram that shows a functional structure of the speech processing apparatus in relation to pitch pattern modeling.

FIG. 2 is a block diagram for showing the functional structure of the speech processing apparatus 100, focusing on its functional units involved in the learning of pitch segment models. The speech processing apparatus 100 includes a parameterizing unit 21 and the model learning unit 22, which are realized in cooperation of the CPU 11 and the programs stored in the ROM 12 or the storage unit 14.

In FIG. 2, "linguistic information (linguistic level $L_i$)" is input from a text analyzing unit that is not shown. The information indicates features of each character string (hereinafter "sample") of a linguistic level $L_i$ contained in the input text, defining the pronunciation of the sample, the stressed position, and the like. This information also indicates the time position of the linguistic features (starting and ending times) with respect to a previously recorded spoken realization of the input text. Log F0 is a logarithmic fundamental frequency that is input from a not-shown device, representing a fundamental frequency (F0) that corresponds to the said spoken realization of the input text. For the sake of simplicity, the following explanation focuses on a situation in which the linguistic level is the syllable. It should be noted, however, that the same process is performed on any other linguistic level.

The parameterizing unit 21 receives as input values the linguistic information of the linguistic level $L_i$ of the input text and the logarithmic fundamental frequency (Log F0) that corresponds to the spoken realization of that text. Then, it divides Log F0 into segments corresponding to the linguistic level (syllables) according to the starting and ending times of the segment as defined in the linguistic information.

The parameterizing unit 21 performs a set of mathematical operations on the log F0 segments to obtain a set of numerical descriptors of that segment. As a result, an extended parameter $EP_i$ (where i agrees with i of the linguistic level $L_i$) is generated for each segment. The generation of the extended parameter $EP_i$ will be discussed later.

Furthermore, when parameterizing the segmented Log F0, the parameterizing unit 21 also calculates a duration $D_i$ (where i agrees with i of the linguistic level $L_i$) of each sample, based on the starting and ending times of the sample defined in the linguistic information. The duration $D_i$ is then output to the model learning unit 22.

The model learning unit 22 receives the linguistic information of the linguistic level $L_i$, the extended parameter $EP_i$, and the duration $D_i$ of each syllable as input values, and learns a statistic model of the linguistic level $L_i$ as a pitch contour model. The above functional units are explained in detail below with reference to FIGS. 3 to 6.

Figure 3:
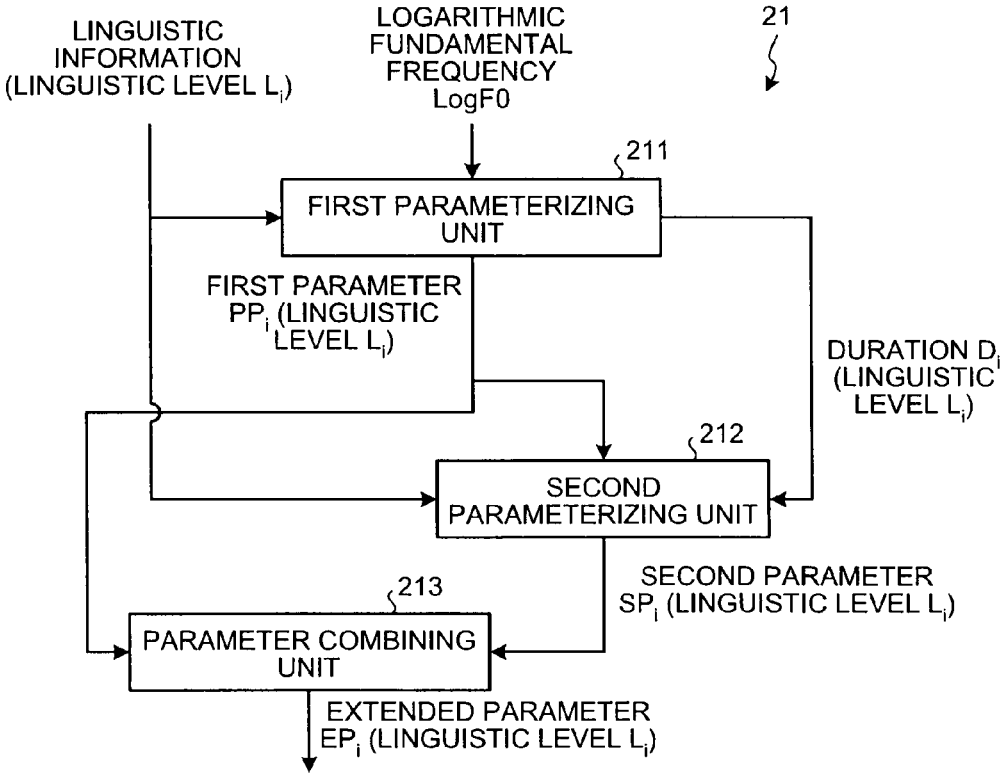
FIG. 3 is a diagram that shows the detailed structure of the parameterizing unit of FIG. 2.

FIG. 3 is a diagram for showing the detailed structure of the parameterizing unit 21 illustrated in FIG. 2, where the parameterizing procedure is indicated with the pointing directions of the line segments that connect the functional units. The parameterizing unit 21 includes a first parameterizing unit 211, a second parameterizing unit 212, and a parameter combining unit 213.

The first parameterizing unit 211 divides the input Log F0 data into syllabic segments in accordance with the linguistic information (linguistic level $L_i$), and generates a first set of parameters $PP_i$ (where i agrees with i of the linguistic level $L_i$) by means of a linear transform of the log F0 segments.

Figure 4:
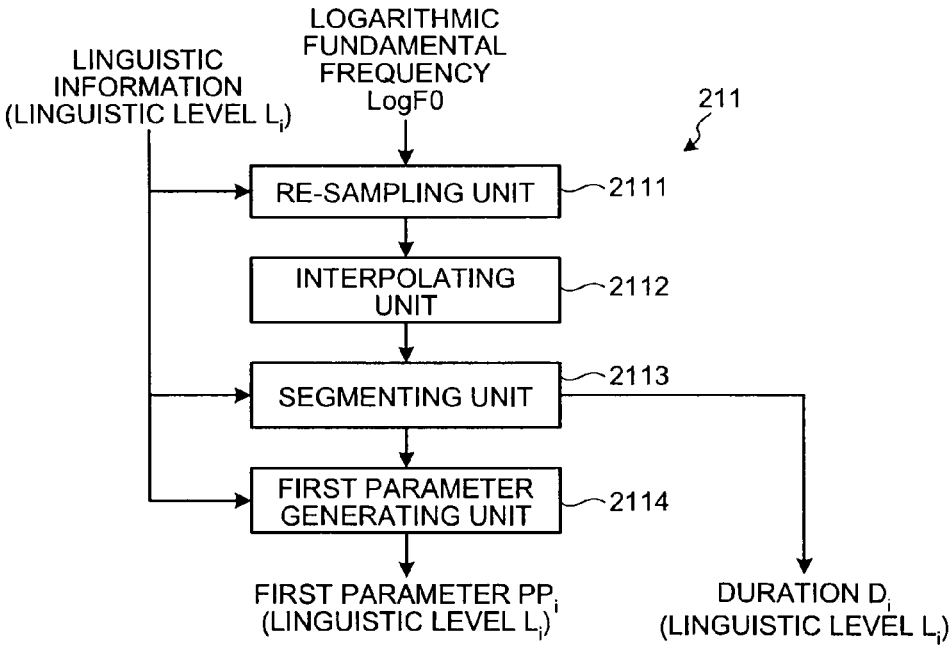
FIG. 4 is a diagram that shows the detailed structure of the first parameterizing unit of FIG. 3.

The generation of the first parameter $PP_i$ is explained in detail below with reference to FIG. 4. In this drawing, the detailed structure of the first parameterizing unit 211, which is involved in the generation of the first parameter $PP_i$, is illustrated. The procedure of generating the first parameter $PP_i$ is indicated with the pointing directions of the line segments that connect the functional units to one another. The first parameterizing unit 211 includes a re-sampling unit 2111, an interpolating unit 2112, a segmenting unit 2113, and a first parameter generating unit 2114. The Log F0 data is a sequence of logarithms of the pitch frequencies for the voiced portions and zero values for the unvoiced portions of the input speech signal. Consequently, it is not a continuous signal. In order to parameterize the pitch contour by means of a linear transforms, we need it to be continuous, at least within the limits of the syllable or the considered linguistic level. In order to obtain a continuous pitch contour, first, the re-sampling unit 2111 extracts reliable pitch values from the discontinuous Log F0 data by using the received linguistic information of the linguistic level $L_i$. According to the embodiment, the following criteria are adopted to determine the reliability of a pitch value:

(1) The autocorrelation obtained for calculating the pitch value is larger than a predetermined threshold (for example, 0.8).

(2) The pitch value was calculated from a speech segment that corresponds to a clearly periodic waveform such as a vowel, a semivowel, or a nasal.

(3) The pitch value falls within a predetermined range (for example, half an octave) around the mean pitch of the syllables.

The interpolating unit 2112 performs an interpolation in time with respect to the log F0 of pitch values accepted by the re-sampling unit 2111. A conventionally known interpolating method, such as spline interpolation, may be used for this operation.

The segmenting unit 2113 divides the continuous Log F0 data interpolated by the interpolating unit 2112 in accordance with the starting and ending times of each sample defined in the linguistic information (linguistic level $L_i$) and outputs the resultant pitch segments to the first parameter generating unit 2114. During this process, the segmenting unit 2113 also calculates the duration ((ending time)−(starting time)) of each syllable, and outputs it to the second parameterizing unit 212 and to the model learning unit 22 that are arranged in the downstream positions.

The first parameter generating unit 2114 applies a linear transform to each segment of the Log F0 obtained by the segmenting unit 2113, and outputs the parameters to the second parameterizing unit 212 and the parameter combining unit 213 that are positioned downstream. The linear transform is performed by using an invertible operator such as a discrete cosine transform, a Fourier transform, a wavelet transform, a Taylor expansion, and a polynomial expansion, e.g. Legendre polynomials. The linear-transform parameterization is generally expressed by equation (1):

$$PP_s = T_s^{-1} \cdot \log F0_s \tag{1}$$

In the above equation, $PP_s$ is a N-dimensional vector that is subjected to the linear transform, Log $F0_s$ is a $D_s$-dimensional vector, where $D_s$ denotes the duration of the syllable, with the segment of the interpolated logarithmic fundamental frequency (Log F0), and $T_s^{-1}$ is a $N \times D_s$ transformation matrix. For the index "s" given to each term of the equation, an identification number (s=the number of segments/syllable) is input to identify each segment (hereinafter, the value "s" in any equation is provided in the same manner).

By the linear transform of the equation (1), the pitch segments of syllables (samples) with different lengths can be expressed by vectors of the same dimension.

Assuming that a truncation of the transformed vector to a N-dimensions does not create any error, an error $e_s$ caused by replacing the N-dimensional $PP_s$ with another N-dimensional vector $PP_s'$ is calculated from equations (2)

$$e_s = [PP_s - PP_s']^T \cdot M_s \cdot [PP_s - PP_s'] \tag{2}$$

where $$M_s = T_s^T T_s \tag{3}$$

When the linear transform is an orthogonal linear transform such as a discrete cosine transform, a Fourier transform, or a wavelet transform, $M_s$ is a diagonal matrix. When an orthonormal transform is adopted, $M_s$ is expressed by equation (4).

$$M_s = Cte \cdot I_s \tag{4}$$

In this equation, $I_s$ is a N×N identity matrix, and Cte is a constant. When a modified discrete cosine transform (MDCT) is adopted as the linear transform, $Cte = 2D_s$. Thus, the equation (2) is rewritten as equation (5) below. It should be noted that $PP_s = DCT_s$ and $PP_s' = DCT_s'$. $D_s$ is a duration of a syllable.

$$e_s = 2 \cdot D_s \cdot [DCT_s - DCT_s']^T \cdot [DCT_s - DCT_s'] \tag{5}$$

The average of the Log $F0_s$ vectors, <Log $F0_s$>, is expressed by equation (6).

$$\langle \mathrm{Log} F0_s \rangle = \frac{1}{D_s} \cdot \mathrm{ones}_s^T \cdot \log F0_s \tag{6}$$

In the equation (6), ones is a $D_s$-dimensional vector whose elements value is 1 for all. Based on this equation, the average of Log F$0_s$, <Log F$0_s$>, after the linear transform of the equation (1) is expressed by equation (7).

$$\langle \mathrm{Log}F0_s \rangle = \frac{1}{D_s} \cdot \mathrm{ones}_s^T \cdot T_s \cdot PP_s = K^T \cdot PP_s \tag{7}$$

In general, K is a vector with only one nonzero element. Thus, equation (7) for the application of the MDCT according to the present embodiment can be rewritten as equation (8). In this equation, $DCT_s[0]$ denotes the $0^{th}$ element of $DCT_s$.

$$\langle \mathrm{Log}\,F0_s \rangle = \sqrt{2} \cdot \mathrm{DCT}_s[0] \tag{8}$$

Furthermore, the variance Log F0$\mathrm{Var}_s$ of Log F$0_s$ can be expressed by equation (9), based on the equations (2) and (7).

$$\mathrm{Log}\,F0\mathrm{Var}_s = PP_s^T \cdot M_s \cdot PP_s - PP_s^T \cdot K^T \cdot K \cdot PP_s \tag{9}$$

When the MDCT is adopted, it can be rewritten as equation (10).

$$\mathrm{Log}\,F0\mathrm{Var}_s = 2 \cdot (\mathrm{DCT}_s^T \cdot \mathrm{DCT}_s - \mathrm{DCT}_s[0]^2) \tag{10}$$

In FIG. 3, the second parameterizing unit 212 generates a second parameters $SP_i$ (where i corresponds to i of the linguistic level $L_i$), which indicates the relationship between the first parameters $PP_i$ of a linguistic level $L_i$, based on the group of the first parameters $PP_i$ of the linguistic level $L_i$ obtained by the first parameterizing unit 211 after the segmentation and the linguistic information of the corresponding linguistic level $L_i$. The second parameterizing unit 212 outputs the generated parameter to the parameter combining unit 213.

Figure 5:
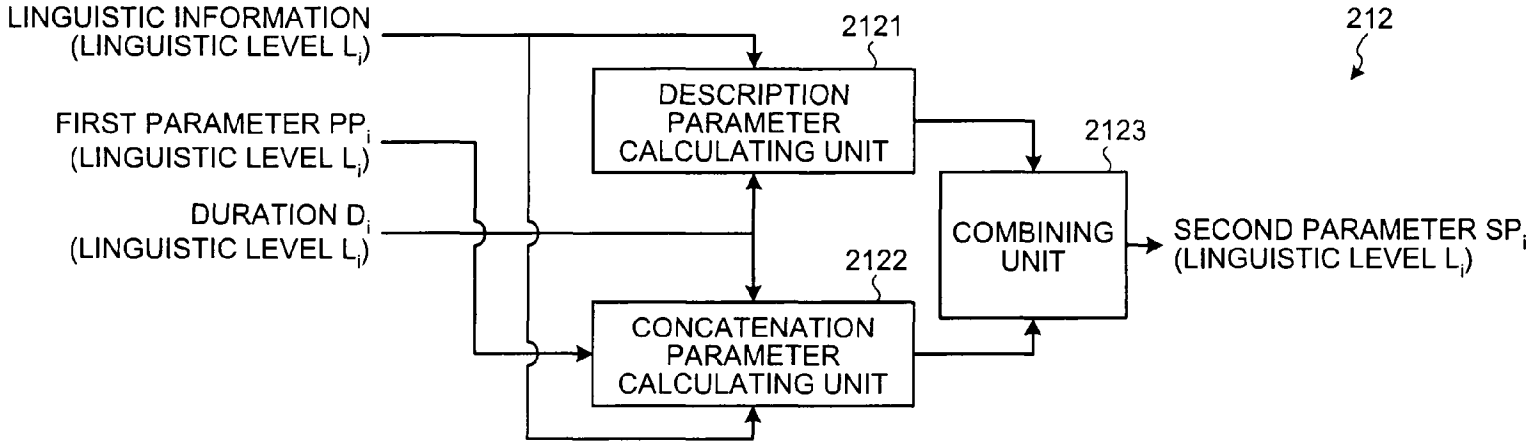
FIG. 5 is a diagram for showing the detailed structure of the second parameterizing unit of FIG. 3.

The generation of the second parameter $SP_i$ is explained in detail with reference to FIG. 5. In this drawing, the detailed structure of the second parameterizing unit 212 involved in the generation of the second parameter $SP_i$ is illustrated, and the pointing directions of the line segments connecting all the functional units show the procedure of generating the second parameter $SP_i$. The second parameterizing unit 212 includes a description parameter calculating unit 2121, a concatenation parameter calculating unit 2122, and a combining unit 2123.

The description parameter calculating unit 2121 generates a description parameter $SP_i^d$, based on the linguistic information of the linguistic level $L_i$, the first parameters $PP_i$ of the linguistic level $L_i$ and the duration $D_i$ received from the first parameterizing unit 211. It outputs the generated parameter to the combining unit 2123. The description parameters represent some additional information to describe one pitch segment not explicitly given by the primary parameters. As such, their values are calculated only with the data associated to one sample (syllable). According to the preset embodiment, it is assumed that the description parameter calculating unit 2121 calculates the variance Log F0$\mathrm{Var}_s$ of Log F$0_s$ from the equation (9) or (10) and that the calculated variance is used as the description parameter.

The concatenation parameter calculating unit 2122 generates a set of concatenation parameter $SP_i^c$, based on the linguistic information of the linguistic level $L_i$, the first parameter $PP_i$ of the linguistic level $L_i$, and the duration $D_i$ received from the first parameterizing unit 211, and outputs the generated parameter to the combining unit 2123.

The concatenation parameter represents the relationship of the first parameters $PP_i$ for one sample (syllable) with those of the adjacent samples (syllables). According to the present embodiment, the concatenation parameter $Sp_i^c$ consists of three terms: a primary derivative ΔAvgPitch of the mean Log F0; the gradient of the interpolated log F0 at the connecting points between target and previous syllable, ΔLog F$0_s^{begin}$ and gradient of the interpolated log F0 at the connecting points between target and next syllables ΔLog F$0_s^{end}$. This parameters are explained below.

The ΔAvgPitch component of the concatenation parameter $Sp_i^c$, the primary derivative of the mean Log F0, is acquired from equation (11).

$$\Delta AvgPitch = \sum_{w=-W}^{W} \beta_w K^T PP_{s+w}[0] \tag{11}$$

In this equation, W is the number of syllables in the vicinity of the target sample (syllable), and β is a weighing factor for calculating the first derivative Δ. When an MDCT is adopted, equation (11) can be rewritten as equation (12).

$$\Delta AvgPitch = \sqrt{2} \cdot \sum_{w=-W}^{W} \beta_w DCT_{s+w}[0] \tag{12}$$

The ΔLog F$0_s^{begin}$ and ΔLog F$0_s^{end}$ components of the concatenation parameter $SP_i^c$, are obtained from equations (13) and (14), respectively, where α is a weighing factor for calculating the gradient.

$$\Delta \mathrm{Log}F0_s^{begin} = \sum_{w=0}^{W} \alpha(w) \cdot \log F0_s(w) + \sum_{w=-W}^{-1} \alpha(w) \log F0_{s-1}(-w) \tag{13}$$

$$\Delta \mathrm{Log}F0_s^{end} = \sum_{w=-W}^{0} \alpha(w) \cdot \log F0_s(w) + \sum_{w=1}^{W} \alpha(w) \log F0_{s+1}(w) \tag{14}$$

In this equation, W is a window length for calculating the gradient at the connection point. By use of the equation (1), (13) and (14) for ΔLog F$0_s^{begin}$ and ΔLog F$0_s^{end}$, it can be rewritten into equations (15) and (16).

$$\Delta \mathrm{Log}\,F0_s^{begin} = H_s^{begin} \cdot PP_s + H_{s-1}^{end} PP_{s-1} \tag{15}$$

$$\Delta \mathrm{Log}\,F0_s^{end} = H_s^{end} \cdot PP_s + H_{s+1}^{begin} PP_{s+1} \tag{16}$$

In these equations, $H_s^{begin}$ and $H_s^{end}$ are fixed vectors that are derived from equations (17) and (18), respectively. $T_s$ is an inverse matrix of the transformation matrix defined by the equation (1), and α is a weighing factor of the equations (13) and (14).

$$H_s^{begin} = \sum_{w=0}^{W} \alpha(w) \cdot T_s(w) \tag{17}$$

$$H_s^{end} = \sum_{w=-W}^{0} \alpha(w) \cdot T_s(-w) \tag{18}$$

According to the conventional HMM-based parameter generation, the primary derivative component Δ and the secondary derivative component ΔΔ used as constraints for the parameter generation, are defined in the same space as the parameters themselves (e.g. log F0). As such, these constraints are defined for a fixed temporal window. In contrast, according to the present embodiment, the ΔLog F$0_s^{begin}$ and ΔLog F$0_s^{end}$ components of the concatenation parameters are not defined in the same space as the parameters themselves (discrete cosine transform space), but directly in the time space of Log F0. The interpretation of this constraints in the transformed space is conducted taking into consideration the duration $D_i$ of the linguistic level such as a phoneme.

The combining unit 2123 generates a second parameter $SP_i$ by combining the description parameter $SP_i^d$ received from the description parameter calculating unit 2121 and the concatenation parameter $SP_i^c$ received from the concatenation parameter calculating unit 2122 for each linguistic Log F0 segment, and outputs the generated parameters to the parameter combining unit 213 that is positioned downstream. According to the present embodiment, the description parameter set $SP_i^d$ and the concatenation parameter set $Sp_i^c$ are combined into the second parameter set $SP_i$, although either one of these parameters may be adopted as the second parameter $SP_i$.

In FIG. 3, the parameter combining unit 213 generates an extended parameter $EP_i$ (where i corresponds to i of the linguistic level $L_i$) by combining the first parameter $PP_i$ and the second parameter $SP_i$ (combination of $SP_i^d$ and $SP_i^c$) and outputs the generated parameter to the model learning unit 22 that is positioned downstream.

The parameter combining unit 213 according to the present embodiment is configured to combine the first parameter $PP_i$ and the second parameter $SP_i$ into the extended parameter $EP_i$. However, the structure may be such that the parameter combining unit 213 is omitted and only the first parameter $PP_i$ is output to the model learning unit 22. In such a structure, the relationship between adjacent samples (syllables) is not taken into consideration. Thus, pitch discontinuities may happen between adjacent syllables, which would make an accentual phrase consisting of multiple syllables or the entire sentence sound prosodically unnatural.

Figure 6:
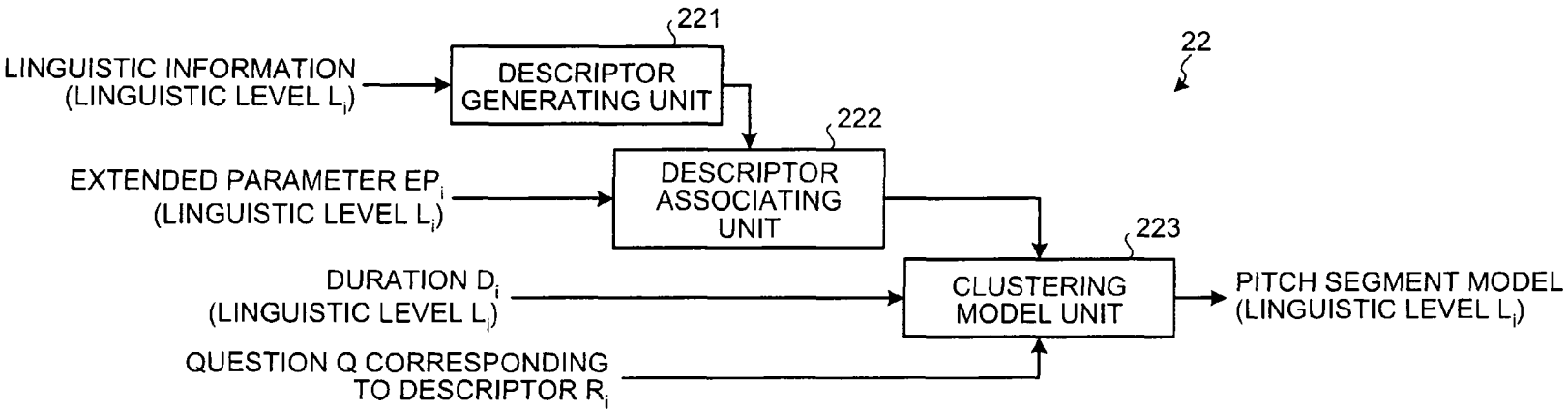
FIG. 6 is a diagram for showing the detailed structure of the model learning unit of FIG. 2.

The pitch segment models learning performed by the model learning unit 22 is explained below with reference to FIG. 6. This drawing shows the detailed structure of the model learning unit 22, where the procedure of learning the pitch segment models is indicated by the pointing directions of the line segments connecting the functional units to one another. The model learning unit 22 includes a descriptor generating unit 221, a descriptor associating unit 222, and a clustering model unit 223.

First, the descriptor generating unit 221 generates a descriptor $R_i$ that consists of a set of features for each sample of a linguistic level $L_i$ in the text. The descriptor associating unit 222 associates the generated descriptor $R_i$ with the corresponding extended parameter $EP_i$.

Then, the clustering model unit 223 clusters the samples by means of a decision tree that distributes the samples into nodes by using a set of question Q corresponding to the descriptor $R_i$ in such a way that certain criterion is optimized. One example of such criterion is the minimization of the mean square error in the Log F0 domain corresponding to the first parameter $PP_i$. This error is created when a vector $PP_i$ representing the first parameter $PP_s$ is replaced with a mean vector PP' stored in a leaf of the decision tree to which the vector $PP_s$ belongs. According to the equation (2), the error can be calculated as a weighted Euclidian distance between the two vectors ($PP_s$–PP'). Thus, the mean square error $<e_s>$ can be expressed by equation (19), where $D_s$ denotes the duration of the corresponding syllable.

$$averageError = <e_s> = \frac{\sum_{\forall s} P(s)\cdot[PP_s - PP']^T \cdot M_s[PP_s - PP']}{\sum_{\forall s} D_s \cdot P(s)} \tag{19}$$

When the MDCT is adopted, the equation (19) is rewritten as in expression (20).

$$averageError = <e_s> = \frac{2\cdot\sum_{\forall s} D_s \cdot P(s)\cdot[DCT_s - DCT']^T \cdot [DCT_s - DCT']}{\sum_{\forall s} D_s \cdot P(s)} \tag{20}$$

In these equations, P(s) is an occurrence probability of the target syllable. For accurate linguistic descriptors, it can be assumed that every syllable has the same probability. Furthermore, the mean square error $<e_s>$ can be expressed as in equation (21) when the weights corresponding to the $DCT_s$ are incorporated for averaging.

$$averageError = <e_s> = \frac{2\cdot\sum_{\forall s} D_s \cdot P(s)\cdot[DCT_s - DCT']^T \cdot \sum_{DCT}^{-1}\cdot[DCT_s - DCT']}{\sum_{\forall s} D_s \cdot P(s)} \tag{21}$$

$\Sigma_{DCT}^{-1}$ is an inverse covariance matrix of the $DCT_s$ vector. The result is basically equal to the clustering result by the maximum likelihood criterion using $D_sP(s)$ in place of P(s).

When clustering is applied directly to the expanded parameter $EP_s$, the mean square error is represented as the sum of all errors in association with the replacement of not only the first parameter $PP_s$ but also the second parameter, which is the differential parameter of the first parameter. More specifically, the mean square error can be expressed as a weighted error that corresponds to an inverse covariance matrix of the $EP_s$ vectors, as in equation (22). In this equation, $M'_s$ is a matrix element as expressed by equation (23), where A is the number of dimensions of the second parameter $SP_s$, and $0_{N\times A}$ and $I_{A\times A}$ denote an all zeros matrix and an identity matrix, respectively.

$$WeightedError = \frac{\sum_{\forall s} P(s)\cdot[EP_s - EP']^T \cdot \sum_{EP}^{-1}\cdot M'_s\cdot[EP_s - EP']}{\sum_{\forall s} D_s \cdot P(s)} \tag{22}$$

$$M'_s = \begin{bmatrix} M_{sN<N} & \overline{O}_{N\cdot A} \\ \overline{O}_{A\cdot N} & I_{A\cdot A} \end{bmatrix}_{(N+A)\cdot(N+A)} \tag{23}$$

The final statistical pitch contour model at Linguistic level i (syllable), consists of a decision tree structure and the mean vectors and covariance matrices of the statistical distributions associated with the leaves of the tree. The method described in the present embodiment corresponds to the syllabic linguistic level. It should be noted, however, that the same process might be applied to other linguistic levels such as phone level, word level, intonational-phrase level, breath group level, or the entire utterance.

The statistical pitch contour models produced by the model learning unit 22 for all the considered linguistic levels, are stored in the storage unit 14. According to the present embodiment, a Gaussian distribution defined by a mean vector of the DCT coefficient vectors and a covariance matrix is adopted for modeling the statistics of the extended parameters in the clusters obtained by the decision tree, although any other statistical distribution may be used to model it. Furthermore, the syllabic level is used as the linguistic level $L_i$ in the explanation, but the same process is executed on other linguistic levels such as those related to phonemes, words, phrases, breath groups, and the entire utterance.

With the claimed parameterization method described in the present embodiment, pitch contour models for different linguistic levels can be obtained. As a result, explicit control on the pitch contour at different supra-segmental linguistic levels can be obtained. On the contrary, on conventional HMM-based pitch generation method, pitch contour is modeled exclusively in units of frames, thus making it difficult to hierarchically integrate models of, for example, the syllabic level or the accentual-phrase level.

Next, the structure and operation of the speech processing apparatus 100 in relation to the pitch contour generation are explained. First, the functional units of the speech processing apparatus 100 and their operations in relation to the pitch contour generation are explained with reference to FIG. 7. In the following explanation, the syllabic level is adopted as a reference linguistic level $L_i$ for the pitch contour generation. However, depending on the application and any other linguistic level can be adopted as a reference level for pitch contour generation.

Figure 7:
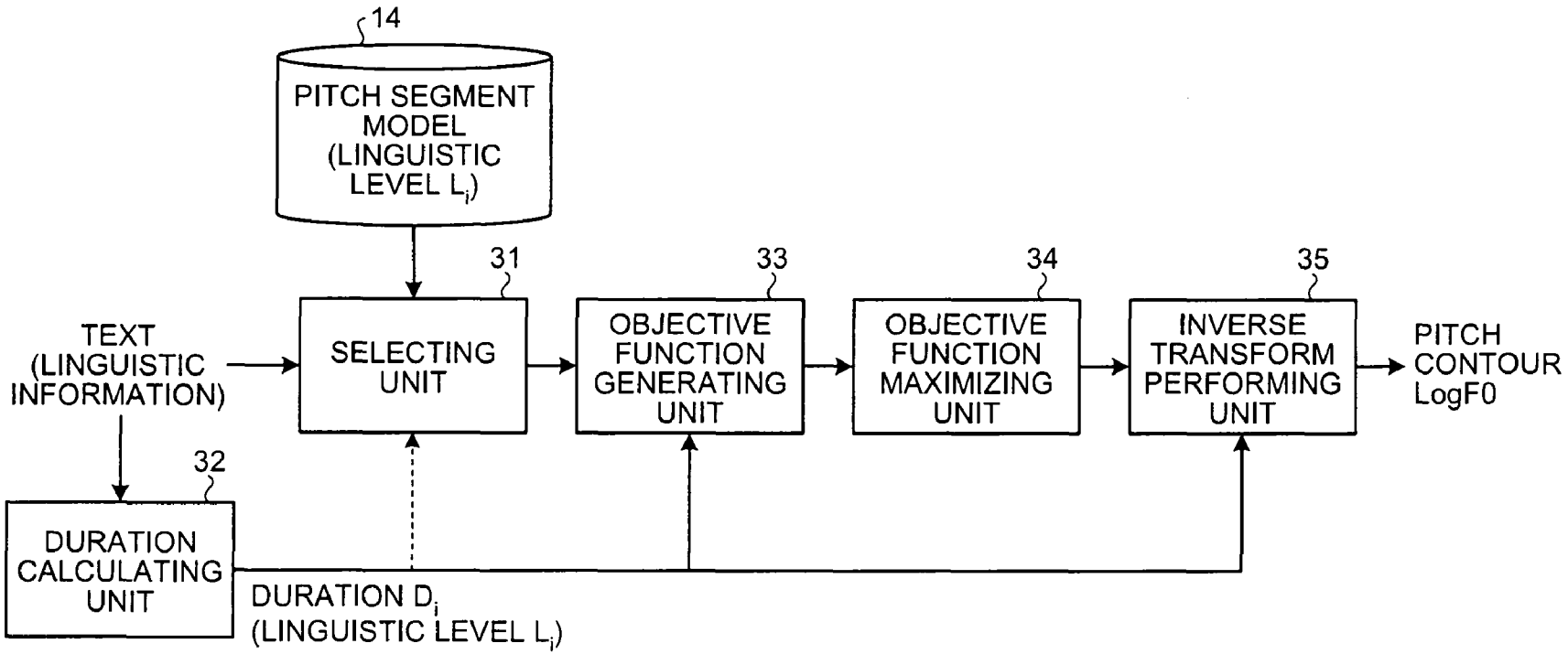
FIG. 7 is a block diagram for showing a functional structure of the speech processing apparatus in relation to the generation of the pitch contour.

FIG. 7 is a block diagram showing a functional structure of the functional units of the speech processing apparatus 100 that are involved in the pitch contour generation. The speech processing apparatus 100 includes a selecting unit 31, a duration calculating unit 32, an objective function generating unit 33, an objective function maximizing unit 34, and an inverse transform performing unit 35, in cooperation with the CPU 11 and the programs stored in the ROM 12 or the storage unit 14.

The selecting unit 31 generates a descriptor $R_i$ for each sample of the linguistic level $L_i$ included in the input text, based on the linguistic information obtained from the text by a text analyzer not depicted in the figure. According to the present embodiment, the descriptor $R_i$ is generated by the selecting unit 31, which is as the descriptor generating unit 221 without the time information (segment begin and segment end). Next, the selecting unit 31 selects a pitch segment model that matches the descriptor $R_i$ for each sample of each linguistic level stored in the storage unit 14. The model selection is realized using the decision tree trained for that linguistic level.

The duration calculating unit 32 calculates the duration of each sample of the linguistic level $L_i$ in the text. For example, when the linguistic level $L_i$ is a syllabic level, the duration calculating unit 32 calculates the duration of each syllable. If the duration or the starting and ending times of the sample are explicitly indicated in the linguistic information of some level, unit 32 can use them to calculate the duration of the sample at the other levels.

The objective function generating unit 33 calculates an objective function for the linguistic level $L_i$, based on the set of pitch segment models selected by the selecting unit 31, and the duration of each sample of the linguistic level $L_i$ calculated by the duration calculating unit 32. The objective function is a logarithmic likelihood (likelihood function) of the extended parameter $EP_i$ (first parameter $PP_i$), expressed as in the terms of the right-hand side of equation (24) for the total objective function F. In this equation, the first term of the right-hand side is related to the syllabic level (i=0), whereas the second term of the right-hand side is related to another linguistic level (i≠1).

$$F = \sum_{\forall s} \lambda_0 \log(P(EP_0^s \mid s)) + \sum_{\forall l \neq 0} \lambda_l \log(P(EP_l \mid U_l)) \tag{24}$$

To acquire a pitch contour, this total objective function F needs to be maximized with respect to a first parameter $PP_0$ of the reference linguistic level (syllabic level). Thus, the objective function generating unit 33 describes the secondary parameter $SP_0$ of each syllable and the extended parameter of each sample at all the other linguistic levels as functions of the first parameter $PP_0$ of the syllable level, as in equations (25) and (26), respectively.

$$SP_0 = f_{SP}(PP_0) \tag{25}$$

$$EP_l = f_l(PP_0) \tag{26}$$

Consequently, the equation (24) can be rewritten into equation (27). In the equation (27), $PP_0$ is a DCT vector of Log F0 for each syllable, and $SP_0$ is the second parameter for each syllable. The terms λ are weighting factor for each factor of the equation.

$$F(PP_0) = \sum_{\forall s} \lambda_0^{PP} \log(P(PP_0^s \mid s)) + \sum_{\forall s} \lambda_0^{SP} \log(P(f_{SP}(PP_0^s) \mid s)) + \sum_{\forall l} \lambda_l \log(P(f_l(PP_0) \mid U_l)) \tag{27}$$

The objective function maximizing unit 34 calculates the set of first parameter $PP_0$ that maximized the total objective function F described in equation (27) which is obtained by adding all the objective functions calculated by the objective function generating unit 33. The maximization of the total log-likelihood function can be implemented by means of a well-known technique such as a gradient method.

The inverse transform performing unit 35 generates a Log F0 vector, i.e., a pitch contour, by performing the inverse transform on the first parameter $PP_0$ of each syllable calculated from the objective function maximizing unit 34. The inverse transform performing unit 35 performs the inverse transform of $PP_0$ considering the duration of each sample of the reference linguistic level (syllable) calculated by the duration calculating unit 32.

Figure 8:
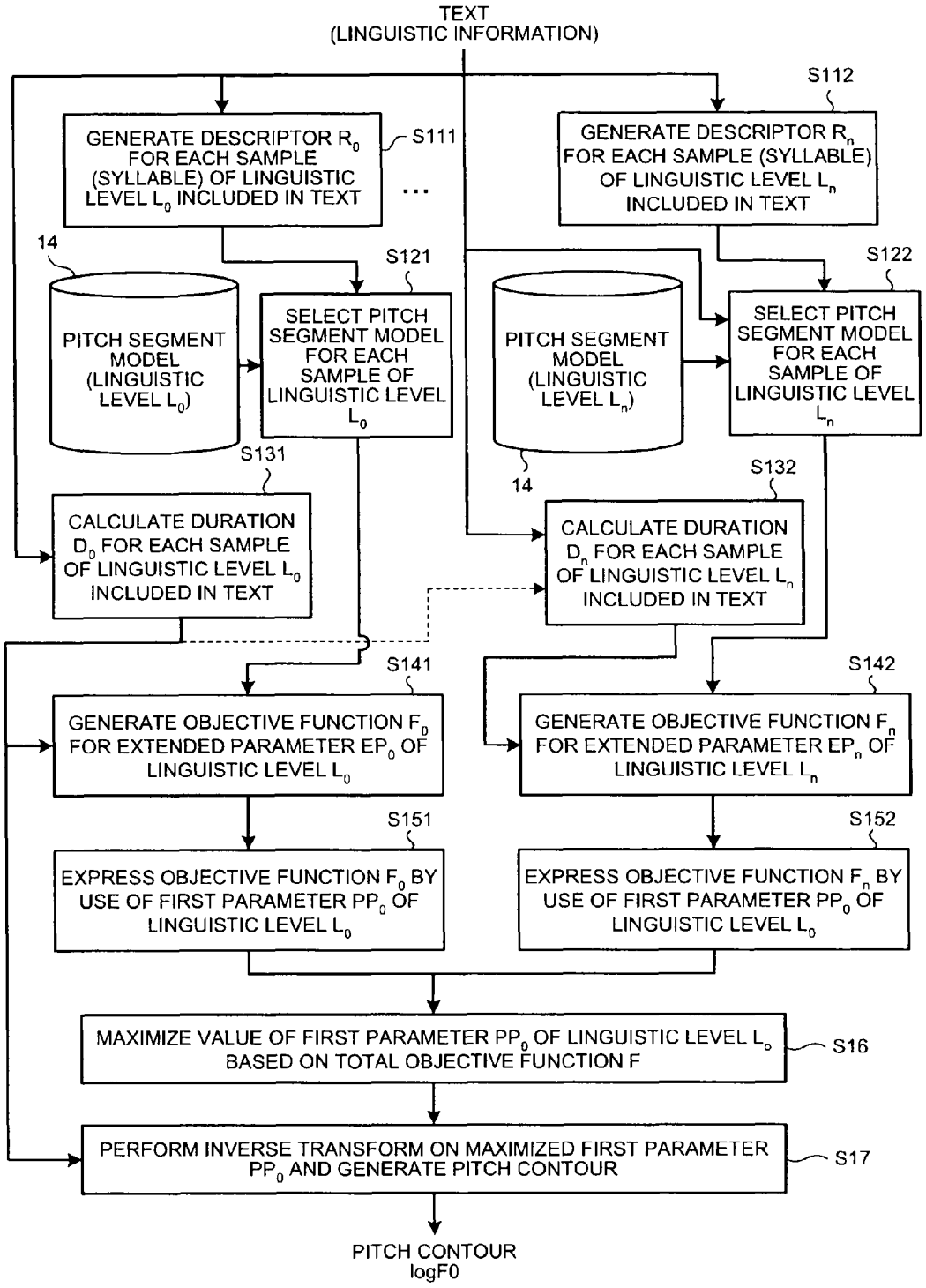
FIG. 8 is a diagram for showing the procedure of generating a pitch contour.

The operation of generating the pitch contour is explained below with reference to FIG. 8. In this drawing, the procedure of the pitch contour generation conducted by the functional units involved in the pitch contour generation is illustrated.

First, the selecting unit 31 generates a descriptor $R_i$ for each sample of each linguistic level $L_i$ from the linguistic information of the input text (Steps S111 and S112). In FIG. 8, descriptors of two linguistic levels, a descriptor $R_0$ of the linguistic level $L_0$ (syllabic) and a descriptor $R_n$ of a linguistic level $L_n$ that is any level other than syllabic (n is an arbitrary number) are indicated.

Based on the descriptors $R_i$ ($R_0$ to $R_n$) generated at Steps S111 and S112, the selecting unit 31 selects a pitch contour model corresponding to each linguistic level from the storage unit 14 (Steps S121 and S122). The model is selected in such a manner that the descriptor of the linguistic level of the input text $R_i$, matches the linguistic information of the pitch contour model as defined by the associated decision tree.

Thereafter, the duration calculating unit 32 calculates a duration $D_i$ for the samples of each linguistic level in the text (Steps S131 and S132). In FIG. 8, the duration $D_0$ of each syllable of the linguistic level $L_0$ (syllabic) and the duration $D_n$ of each sample of the other linguistic levels $L_n$ are calculated.

Next, the objective function generating unit 33 generates an objective function $F_i$ for each linguistic level $L_i$ in accordance with the pitch segment models of the linguistic levels $L_i$ selected at Steps S111 and S112 and the durations $D_i$ of the linguistic levels calculated at Steps S131 and S132 (Steps S141 and S142). In FIG. 8, the objective function $F_0$ and the objective function $F_0$ are generated with respect to the linguistic level $L_n$ (syllabic) and the linguistic level $L_n$, respectively. The objective function $F_0$ corresponds to the first term on the right-hand side of the equation (24), whereas the objective function $F_n$ corresponds to the second term on the right-hand side of the equation (24).

Next, the objective function generating unit 33 needs to express the objective functions generated at Steps S141 and S142 with the first parameter $PP_0$ of the reference linguistic level $L_0$. Thus, the objective functions of the linguistic levels $L_i$ are modified by using the equations (25) and (26) (Steps S151 and S152). More specifically, the objective function $F_0$ is modified by using the equation (25) into the first and second terms of the right-hand side of the equation (27). The objective function $F_n$ is modified by using the equation (26) into the third term of the right-hand side of the equation (27).

The objective function maximizing unit 34 maximizes the total log-likelihood function based the sum of the objective functions of the linguistic level $L_i$ modified at Steps S151 and S152, (the total objective function $F(PP_0)$ in the equation (27)), with respect to the first parameter $PP_0$ of the reference linguistic level $L_0$ (Step S16).

Finally, the inverse transform performing unit 35 generates the log F0 sequence from the inverse transform of the first parameter $PP_0$ that maximized the objective function in the maximizing unit 34. The logarithmic fundamental frequency Log F0 describes the intonation of the text, or in other words, the pitch contour (Step S17).

With the method of generating the pitch contour according to the present embodiment, a pitch contour is generated in a comprehensive manner by using pitch contour models of different linguistic levels. Thus, the generated pitch contour changes smoothly enough to make the speech sound natural.

The number and types of linguistic levels used for the pitch contour generation and the reference linguistic level can be arbitrarily determined. It is preferable, however, that a pitch contour is generated by using a supra-segmental linguistic level, such as the syllabic level adopted for the present embodiment.

The speech processing apparatus 100 according to the present embodiment statistically models the pitch contour by using supra-segmental linguistic level such as a syllabic level. It can also generate a pitch contour by maximizing the objective function defined as the log-likelihood of the pitch contour given the set of statistic model that correspond to the input text. Since these statistical models define constraints such as the pitch difference and the gradient at a connection point, a smoothly-changing and naturally-sounding pitch contour can be generated.

Other embodiments may be structured in such a manner that the objective function also takes into consideration a global variance. This allows the dynamic range of the generated pitch contour to be similar that of natural speech, offering a still more natural prosody. The global variance of the pitch contour can be expressed in terms of the DCT vector at syllable level by equation (28).

$$AverageF0GlobalVar = \frac{1}{S}\sum_{\forall s} DCT_s[0]^2 - \left(\frac{1}{S}\sum_{\forall s} DCT_s[0]\right)^2 \quad (28)$$

When the objective function is maximized by adding this global variance to the objective function, the partial differential of the objective function with respect to the first parameter $PP_0$ becomes a nonlinear function. For this reason, the maximization of the objective function has to be performed by a numerical method such as the steepest gradient method. The vector of means of the syllable models can be adopted as initial value for the algorithm.

The exemplary embodiments of the present invention have been explained. The present invention, however, is not limited to these embodiments, and various modifications, replacements, and additions may be made thereto without departing from the scope of the invention.

For example, a program executed by the speech processing apparatus 100 according to the above embodiment is installed in the ROM 12 or the storage unit 14. However, the program may be stored as a file of an installable or executable format in a computer-readable recording medium such as a CD-ROM, a flexible disk (FD), a CD-R, and a digital versatile disk (DVD).

Furthermore, this program may be stored in a computer that is connected to a network such as the Internet, and downloaded by way of the network, or may be offered or distributed by way of the network.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech processing apparatus, comprising:

a segmenting unit configured to divide a fundamental frequency signal of a speech signal corresponding to an input text into a plurality of pitch segments, based on an alignment between samples of at least one given linguistic level included in the input text and the speech signal, wherein character strings of the input text are divided into the samples based on each linguistic level;

a parameterizing unit configured to generate a parametric representation of the pitch segments by means of a predetermined invertible operator such as a linear transform, and generate a group of first parameters in correspondence with each linguistic level;

a descriptor generating unit configured to generate, for each linguistic level, a descriptor that includes a set of features describing each sample in the input text;

a model learning unit configured to classify the first parameters of each linguistic level of all speech signals in a memory into clusters based on the descriptor corresponding to the linguistic level, and learn, for each of the clusters, a pitch segment model for the linguistic level; and a storage unit configured to store the pitch segment models for each linguistic level together with mapping rules between the descriptors describing the features of the sample, for the linguistic level and the pitch segment models.

2. The apparatus according to claim 1, wherein the segmenting unit further comprises:

a re-sampling unit configured to extract, from the fundamental frequency, a plurality of pitch frequencies that match a predetermined condition, an interpolating unit configured to perform an interpolation of the pitch frequencies extracted by the re-sampling unit and smooth the fundamental frequency to obtain an interpolated pitch contour, wherein the segmenting unit divides the interpolated pitch contour into the pitch segments that correspond to the linguistic level.

3. The apparatus according to claim 1, wherein in addition to the invertible parametric representation, the parameterizing unit further includes an additional description-parameter calculating unit configured to calculate a set of description parameters representing further characteristics of the first parameters such as their variance, so that the model learning unit conducts learning with respect to an expanded parameter obtained by combining, for each linguistic level, the first parameters, with its associated description parameter set.

4. The apparatus according to claim 1, wherein in addition to the invertible parametric representation, the parameterizing unit further comprises an additional concatenation parameter calculating unit configured to calculate a set of concatenation parameters representing a relationship between adjacent pitch segments of the linguistic level including a primary derivative of the average of the fundamental frequency of current and adjacent pitch segments, or a gradient of the fundamental frequency at a connection point of the pitch segments for the linguistic level, wherein the model learning unit conducts learning with respect to an expanded parameter obtained by combining, for each linguistic level, the first parameters with its associated concatenation parameter set.

5. The apparatus according to claim 1, wherein the model learning unit classifies the parametric representation of the pitch segments of each linguistic level into groups by means of a decision tree that uses the set of features contained in the descriptor generated by the descriptor generating unit.

6. The apparatus according to claim 5, wherein the decision tree classifies the parametric representation of the pitch segments so as to minimize a total mean square error in a non-transformed pitch contour space, the error being calculated from the first parameters of the pitch segments and their associated duration.

7. The apparatus according to claim 5, wherein the decision tree classifies the parametric representation of the pitch segments so as to maximize a total logarithmic likelihood (log-likelihood), the log-likelihood being calculated from the parametric representation of the pitch segments and their associated duration.

8. The apparatus according to claim 1, wherein the linguistic level relates to any one of a frame, a phoneme, a syllable, a word, a phrase, a breath group, an utterance, or any combination thereof.

9. The apparatus according to claim 1, wherein the transform is any one of invertible linear transforms including a discrete cosine transform, a Fourier transform, a wavelet transform, a Taylor expansion, and a polynomial expansion.

10. The apparatus according to claim 1, further comprising:

a selecting unit configured to select from the storage unit a pitch segment model corresponding to each descriptor, for a single linguistic level or a plurality of linguistic levels;

an objective function generating unit configured to generate an objective function from a group of pitch segment models selected for each linguistic level;

an objective function maximizing unit configured to generate the first parameters corresponding to character strings of the reference linguistic level that maximize a weighted sum of the objective functions of each linguistic level with respect to the first parameters of a reference linguistic level; and an inverse transform performing unit configured to perform an inverse transform on the first parameters generated from the maximization of the objective function by the maximizing unit, and generate a pitch contour.

11. The apparatus according to claim 10, wherein the objective functions generated by the objective function generating unit are defined in terms of the first parameters of the reference linguistic level.

12. The apparatus according to claim 11, wherein the objective function generating unit is configured to generate the objective function of the linguistic level as a likelihood function of the first parameters of the reference linguistic level.

13. A speech processing method, comprising:

dividing a fundamental frequency signal of a speech signal corresponding to an input text into a plurality of pitch segments, based on an alignment between samples of at least one given linguistic level included in the input text and the speech signal, wherein character strings of the input text are divided into the samples based on each linguistic level;

generating a parametric representation of the pitch segments by means of a predetermined invertible operator such as a linear transform, and generating a group of first parameters in correspondence with each linguistic level;

generating, for each linguistic level, a descriptor that includes a set of features describing each sample in the input text;

classifying the first parameters of each linguistic level of all speech signals in a memory into clusters based on the descriptor corresponding to the linguistic level, and learning, for each of the clusters, a pitch segment model for the linguistic level;

storing the pitch segment models for each linguistic level together with mapping rules between the descriptors describing the features of the samples for the linguistic level and the pitch segment models in a storage unit.

14. A non-transitory computer-readable medium including programmed instructions for processing speech, wherein the instructions, when executed by a computer, cause the computer to perform:

dividing a fundamental frequency signal of a speech signal corresponding to an input text into a plurality of pitch segments, based on an alignment between samples of at least one given linguistic level included in the input text and the speech signal, wherein character strings of the input text are divided into the samples based on each linguistic level;

generating a parametric representation of the pitch segments by means of a predetermined invertible operator such as a linear transform, and generating a group of first parameters in correspondence with each linguistic level;

generating, for each linguistic level, a descriptor that includes a set of features describing each sample in the input text;

classifying the first parameters of each linguistic level of all speech signals in a memory into clusters based on the descriptor corresponding to the linguistic level, and learning, for each of the clusters, a pitch segment model for the linguistic level;

storing the pitch segment models for each linguistic level together with mapping rules between the descriptors describing the features of the samples for the linguistic level and the pitch segment models in a storage unit.

* * * * *